US005259448A

United States Patent [19]

Masukawa et al.

[11] Patent Number: 5,259,448

[45] Date of Patent: Nov. 9, 1993

[54] HEAT TRANSFER TUBES AND METHOD FOR MANUFACTURING

[75] Inventors: Seizo Masukawa; Shunroku Sukumoda, both of Aizuwakamatsu, Japan

[73] Assignee: Mitsubishi Shindoh Co., Ltd., Tokyo, Japan

[21] Appl. No.: 906,948

[22] Filed: Jun. 30, 1992

[30] Foreign Application Priority Data

Jul. 9, 1991 [JP] Japan ..... 3-168516
Mar. 30, 1992 [JP] Japan ..... 4-074463

[51] Int. Cl.[5] ..... F28F 1/40

[52] U.S. Cl. ..... 165/133; 165/179; 165/184

[58] Field of Search ..... 165/133, 184, 181, 179

[56] References Cited

U.S. PATENT DOCUMENTS 3,861,462 1/1975 McLain ..... 165/179
4,733,698 3/1988 Sato ..... 165/179
5,052,476 10/1991 Sukumoda et al. ..... 165/133

FOREIGN PATENT DOCUMENTS 68554 6/1979 Japan ..... 165/133
59194 5/1981 Japan ..... 165/133
113996 9/1981 Japan ..... 165/133
58092 4/1982 Japan ..... 165/133
104094 6/1982 Japan ..... 165/133
104095 6/1982 Japan ..... 165/133
37693 2/1987 Japan ..... 165/133
165875 6/1990 Japan ..... 165/179

*Primary Examiner*—John Rivell
*Assistant Examiner*—L. R. Leo
*Attorney, Agent, or Firm*—Darby & Darby

[57] ABSTRACT

The heat transfer tube of the present invention is provided in an inner surface thereof with a plurality of main grooves and a plurality of narrow grooves. The main grooves have rectangular shaped cross sections, parallel to one another, and extend at an angle to the longitudinal direction of the heat transfer tube. The narrow grooves are formed parallel to one another, extend independently of the main grooves. Each of the narrow grooves has a bottom face and a pair of side faces, the side faces are inclined closely toward the bottom face, and each of the side faces and a part of the bottom face form sharp cuts.

11 Claims, 18 Drawing Sheets (evaporation performance test)

(condensation performance test)

HEAT TRANSFER TUBES AND METHOD FOR MANUFACTURING

BACKGROUND OF THE INVENTION

1. Field of the Invention

The present invention relates to heat transfer tubes which are utilized as vaporization and condensation tubes in apparatus such as heat exchangers and heat pipes.

2. Background Art

Heat transfer tubes made of metals, such as copper, having many straight or helical grooves on the inner surfaces, which can be manufactured by drawing processes, have been known in the past.

These grooves provide the following benefits:

1. When used as condensation tubes, these heat transfer tubes produce improved liquefaction efficiency by increasing the turbulence of the vapors as well as improved nucleation of the liquid phase brought about by the action of the surface irregularities. Furthermore, the surface tension effects on the liquid in the grooves serve to retain the fluid and promote good drainage, leading to increased reflux efficiency.

2. When these tubes are used in vaporizers, the edges of the grooves act as nucleation sites for the bubbles to provide rapid boiling, thus increasing the efficiency of liquid to vapor conversion. Furthermore, the surface tension effects serve to distribute the vaporizing liquid evenly throughout the vaporizer, promoting efficient conversion.

In order to improve the performance of such heat transfer tubes, a heat transfer tube shown in FIG. 33 was proposed in Japanese Patent Application Kokai No. 1-317637. This heat transfer tube comprises many straight or helical grooves 2 and many cuts 3 crossing to the grooves 2 on the inner surface thereof.

This heat transfer tube can be manufactured as follows:

Many primary grooves having a V cross-sectional shape, which will become the cuts 3 later, are formed on the inner surface of a metal tube by drawing a primary plug through the tube. Next, many secondary grooves 2 extending at an angle to the primary grooves are formed by drawing a secondary plug through the tube, and the primary grooves are narrowed by the formed secondary grooves 2, and change into cuts 3.

When this heat transfer tube is used as evaporating tube, many little bubbles of vapor generate from the cuts 3, and boiling of the liquid is accelerated. Therefore evaporation performance is improved in comparison with simple grooved tubes.

Furthermore, since the cuts 3 of this tube are nearly closed, these cuts hold firmly minute bubbles which act as nuclei for the formation of vapor, therefore, good evaporation performance will be maintained for a long time. In contrast, in the heat transfer tube having open grooves instead of the cuts 3, such minute bubbles will flee from the grooves little by little during the operation, and evaporation performance will become gradually lower.

The above mentioned tubes, however, have the following drawbacks:

When the heat transfer tube is used for heat exchanger or the like, it is necessary to enlarge the diameters of ends of the tubes by means of insertion of an enlarging plug in order to connect another tubes to the ends. However, in the tube of FIG. 33, since the tube has many sharp cuts 3 on the inner periphery, a risk arises that the ends of the tube will tear as the plug is inserted. To prevent the cracks at the ends of the tube, the cuts 3 should be made shallow, however such shallow cuts do not offer sufficient effect for promoting evaporation performance.

SUMMARY OF THE INVENTION

The present invention relates to heat transfer tube with improved heat transfer characteristics and mechanical strengths by overcoming the deficiencies present in the conventional heat exchanger tubes.

The heat transfer tube of the present invention is provided in an inner surface thereof with a plurality of main grooves and a plurality of narrow grooves. The main grooves have rectangular shaped cross sections, parallel to one another, and extend at an angle to the longitudinal direction of the tube. The angle can be settled optionally int he range of 4°-90°. The narrow grooves are formed parallel to one another, and extend independently of the main grooves. The angle between the narrow grooves and the main grooves can be settled optionally in the range of 0°-90°. Each of the narrow grooves has a bottom face and a pair of side faces therein, the side faces are inclined closely toward the bottom face, and each of the side faces and a part of the bottom face form a sharp cut nearly symmetrically in a cross section of the narrow groove.

In the heat transfer tubes according to the present invention, since the depth direction of each cut formed inside the narrow grooves is nearly parallel with the inner surface of the tube, it is possible to prevent the cracking along the cuts in the ends of the tube when plugs are inserted into the ends in order to enlarge diameters of the ends. Therefore, it is possible to form the cuts deeply enough to improve the evaporation characteristics. When the depth of each cut is deep and the opening of the cut are suitably narrow, more minute bubbles which act as nuclei for the formation of vapors are retained in the cuts for a long time, and these minute bubbles promote boiling and vaporization process of the heating medium liquid when the tube is used as the vaporization tube.

The method of manufacturing the heat transfer tubes according to the present invention comprises the following steps of:

(a) preparing a metal strip having a generally constant width defined between side edges;

(b) roll-forming primary grooves parallel to one another on a surface of the strip, each of the primary grooves having a rectangular shaped cross section, and each primary groove having a bottom face and a pair of side faces;

(c) roll-forming secondary grooves having a rectangular shaped cross section on the surface of the strip independently of the primary grooves, thereby inclining side faces of each primary groove closely toward the bottom face thereof, and forming a pair of sharp cuts between each of the side faces and the bottom face symmetrically;

(d) roll-forming the strip into a tube so that the surface of the strip becomes a inner surface of the tube; and (e) joining the side edges of the strip to form complete tube.

In accordance with this manufacturing method, it is possible to manufacture high performance heat transfer tubes which had been difficult to manufacture previously.

DETAILED DESCRIPTION OF THE PREFERRED EMBODIMENTS

The preferred embodiments of the present invention are explained with reference to FIGS. 1 to 32, inclusively.

Figure 1:
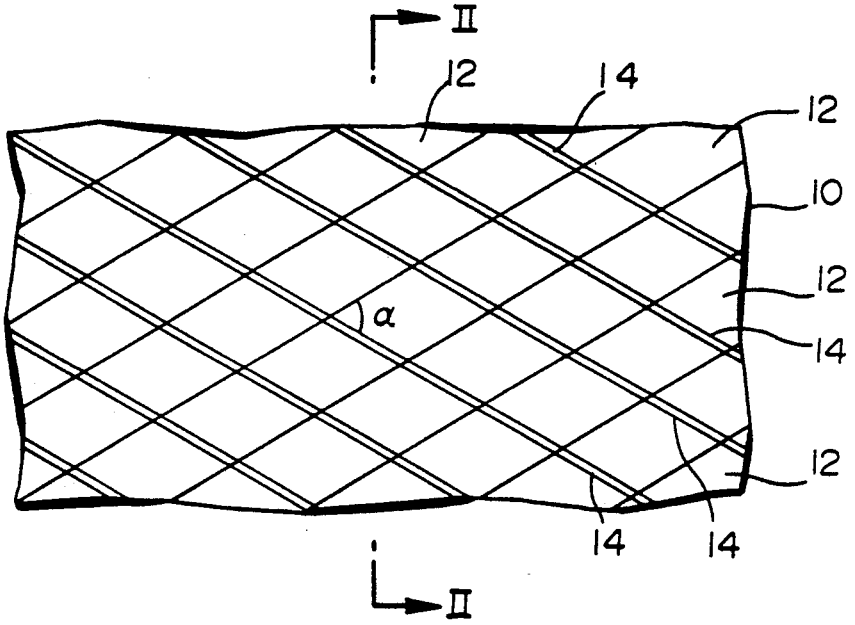
FIG. 1 is a development of inner surface of a preferred embodiment of the present invention.
Figure 2:
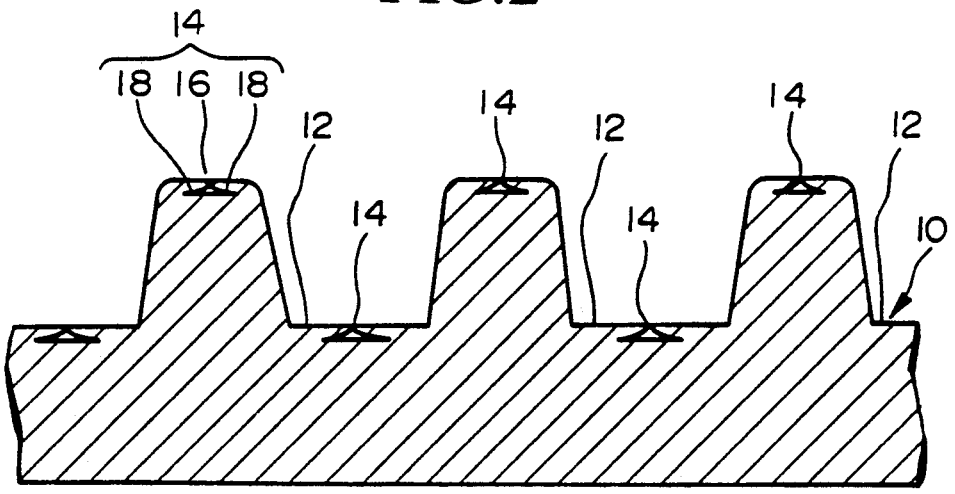
FIG. 2 is an enlarged cross sectional drawing of the heat transfer tube along the line II—II shown in FIG. 1.
Figure 3:
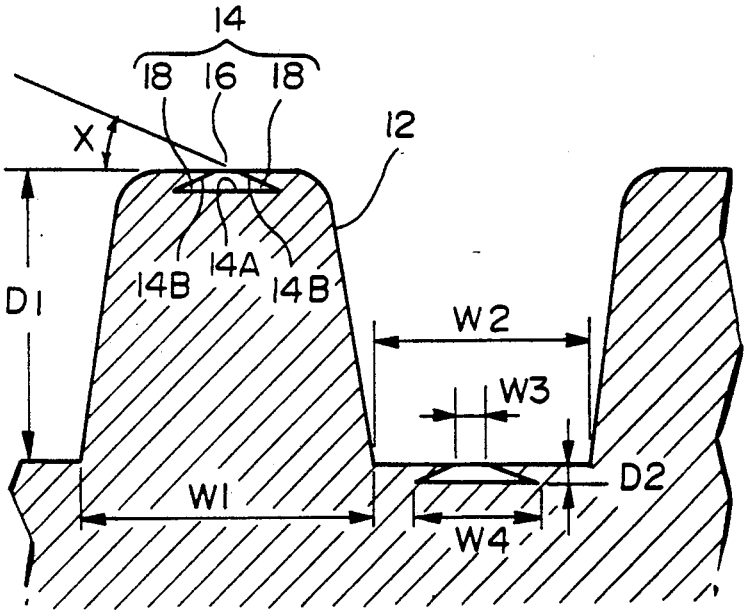
FIG. 3 is an enlarged cross sectional drawing of the main grooves and narrow grooves formed on the inner surface of the heat transfer tube.

FIGS. 1 to 3 show a heat transfer tube 10 of the first embodiment. This tube 10 is made of conventional materials such as copper, copper alloys, aluminum and aluminum alloys, with the choice of wall thickness and diameter being governed by individual requirements.

The heat transfer tube 10 comprises a plurality of parallel main grooves 12 and a plurality of parallel narrow grooves 14 on the inner surface thereof. The main grooves 12 have rectangular shaped cross sections, and extend at an angle to the longitudinal direction of the tube 10. The angle between the main grooves 12 and the tube axis can be settled optionally in the range of 0°–90°. However, it is desirable that the main grooves 12 be oriented less than 30° from the tube axis. Larger deviation angles cause poor drainage of heat medium liquid in the longitudinal direction of the tube 10. Regarding the angle $\alpha$ between the narrow grooves 14 and the main grooves 12, it can be settled optionally in the range of 0°–90°.

Figure 4:
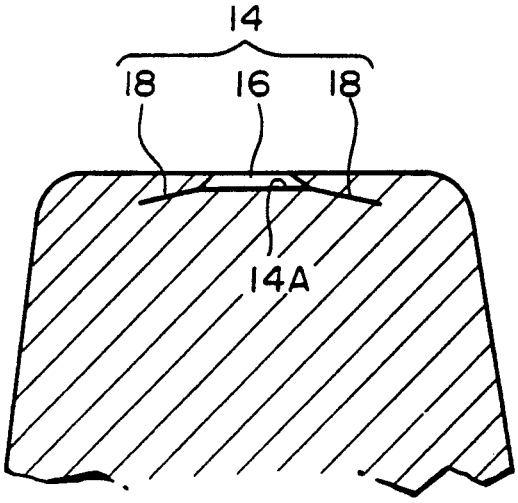
FIG. 4 is an enlarged cross sectional drawing of the narrow grooves of the other embodiment of the present invention.
Figure 5:
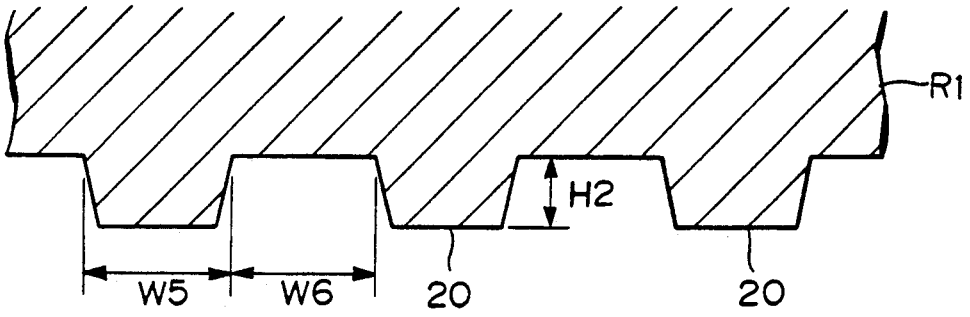
FIG. 5 is a cross sectional drawing of a primary forming roll used in a method for manufacturing the heat transfer tube of the present invention.

As shown in FIG. 3, the narrow grooves 14 are formed independently of main grooves 12, each narrow grooves 14 has a bottom face 14A which is nearly parallel with the inner surface of the tube 10, and a pair of side faces 14B. The side faces 14B are inclined closely toward the bottom face 14A, thereby each of the side faces 14B and the bottom face 14A form a sharp cut 18 symmetrically in a cross section of the narrow groove 14. Each cut 18 has a sharp V-shape or Y-shape cross section, for example as shown in FIGS. 3 and 4. Even if the deep part of the cut 18 is closed as in FIG. 4, the cut 18 can hold many minute bubbles in the closed portion, and can improve the evaporation efficiency of the tube 10.

In the case of heat transfer tubes for common purposes, preferable dimensions are follows; depths D1 of the main grooves 12 are in the range of 0.15–0.35 mm, intervals W1 of the main grooves 12 are 0.15–0.3 mm, and bottom widths W2 of the main grooves 12 are 0.15–0.3 mm. In the tube having these dimensions, the capillary action of the main grooves 12 becomes maximum, and it is possible to improve the flow speed of heat medium liquid supplied in the tube.

As well, preferable depths D2 of the narrow grooves 14 are 0.01–0.05 mm, preferable bottom widths W4 thereof are 0.03–0.1 mm, and preferable widths W3 of opening 16 of the narrow grooves 14 are in the range of 10–60% of the width W4. When the narrow grooves 14 have these dimensions, it is possible to retain excellent effect for holding minute bubbles inside the cuts 18 for a long time, and to improve the evaporation efficiency of the tube.

Furthermore, angles X between the inner surface of the tube 10 and the depth direction of each cuts 18 are preferably less than 20°. If these angles X are more than 20°, the risk arises that end of the tube are cracked by the insertion of a plug.

In according with the heat transfer tubes 10 of this embodiment, since depth directions of the cuts 18 formed inside the narrow grooves 14 are nearly parallel with the inner surface of the tube 10, it is possible to prevent the cracking along the cuts 18 in the ends of the tube when plugs are inserted into the ends in order to enlarge diameters thereof. Therefore, it is possible to form the cuts 18 deeply enough to improve the evaporation characteristics. In case where the depth of each cut 18 is deep and the opening of the cut 18 are narrow suitably, many minute bubbles which act as nuclei for the formation of vapors are maintained in the cuts 18 for a long time, and these minute bubbles promote boiling and vaporization process of the heat medium liquid when the tube 10 is used as the vaporization tube.

Furthermore, since the narrow grooves 14 have flat shapes and their content volume is very small, bubbles generated in the cuts 18 will be soon released from the narrow grooves 14 before they grow bigger. By this reason, the narrow grooves 14 are hardly filled with vapor, heat conductivity between the inner surface and the outer surface of the heat transfer tube 10 is not reduced by the narrow grooves 14, and the heat efficiency of the heat medium is kept high. In contrast, if the narrow grooves 14 have larger content volume, the narrow grooves 14 will be filled with the vapor, and the heat conductivity between the inner surface and the outer surface of the tube 10 is reduced by the vapor in the narrow grooves 14.

In case where the tube is a seam welded tube, a welding seam extending in the direction of the tube axis is formed in the interior of the heat transfer tube 10, and the welding seam intersects the main grooves 12 and the narrow grooves 14. In this case, since the grooves 12 and 14 are divided by the welding seam, it is possible to prevent the heat medium liquid from covering all the inner surface of the tube along the grooves 12 and 14. If all the inner surface of the tube 10 is covered by the liquid, since the vapor cannot touch directly metal surface of the tube 10, condensation efficiency will be decreased.

Next, the manufacturing methods of the present invention are described. First, a strip metal material is roll-formed continuously by means of a primary roll R1 shown in FIG. 5 and a secondary roll R2 shown in FIG. 6.

On the exterior surface of the roll R1 are present many long parallel protrusions 20 extending at an angle to the circumferential direction of the roll R1. The angle can be set in the range 0°–90° in according to the angle of the narrow grooves 14. These protrusions 20 have rectangular cross sections, and transcribe their shapes on the surface of the strip materials, thus forming parallel primary grooves which will become narrow grooves 14 later. Preferably, the heights H2 of the protrusions 20 are set in the range of 30–160% of widths W5 of the protrusions 20. If the heights H2 are less than 30% of the widths W5, it is difficult to manufacture the cuts 18 having suitable depths. Also, if the height H2 are more than 160% of the widths W5, it becomes difficult to form the cuts 18 as a sharp V-shape or a Y-shape, furthermore the mechanical strength of the tube 10 decrease. Intervals W6 of the protrusions 20 can be set in optionally dimension, however, preferable intervals are in the range of 0.5 to 20 times of the width W5.

Figure 6:
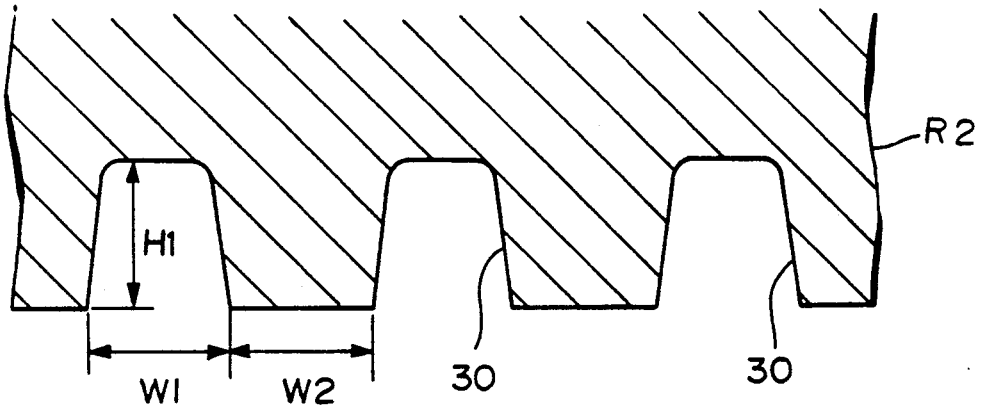
FIG. 6 is a cross sectional drawing of the secondary forming roll used in the manufacturing method for the heat transfer tube of the present invention.

The exterior surface of the secondary roll R2 has a series of parallel long protrusions 30, which have rectangular cross sections as shown in FIG. 6. The protrusions 30 are extending at an angle to the circumferential direction of the roll R2, the angle is set in according to the angle of the main groove 12. The dimensions of the protrusions 30 are the same as the ones of the main grooves 12 shown in FIG. 3.

Figure 7:
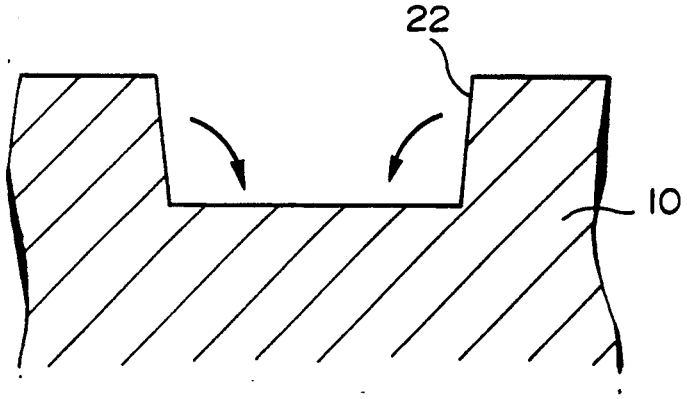
FIGS. 7(*a*) and 7(*b*) are enlarged cross sectional drawings to show a method of forming the narrow groove.
Figure 7:
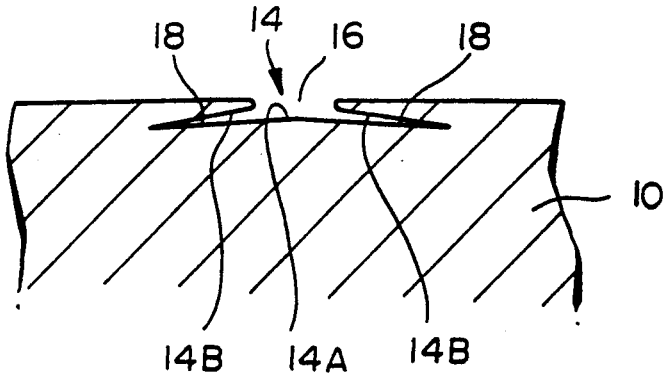

By means of the roll-forming using the secondary roll R2, the main grooves 12 are formed on the surface of the strip, at the same time, the both side faces 14B of the primary grooves 22 are inclined closely toward the bottom face 14A thereof, so that the narrow grooves 14 each having a pair of the cuts 18 are formed as shown in FIGS. 7(*a*) and 7(*b*).

After the completion of the two roll-forming processes to form the grooves 12 and 14, the strip is roll-formed into a tube by roll-forming machine, which has a series of shaper rolls and a seam welder. By means of passing through the shaper rolls of progressively smaller diameters, the strip is made into a tubular shape with the grooved surface facing the interior thereof, further the both side edges of the strip are seam welded to each other by the welder.

The equipment for the seam welding can be any common types, and the usual welding conditions can be employed. The welded region can be further treated, as necessary, cleaned and the tube is wound on a spool or cut into desired lengths to be used as heat transfer tubes.

The manufacturing method described heretofore, the roll-forming of the grooves 12 and 14, shaping and seam welding of the tube 10 can be performed as an in-line processes, thus enabling efficient mass production of the present embodiments at a low cost.

The above mentioned preferred embodiments described a case of a round cross sectional tube, but the applicability of this invention is not limited to such a round shape only but applies equally well to elliptical as well as flattened tube shapes.

Also, the preferred embodiment described in this invention related a case of a strip material of a width sufficient to produce a single tube, but the invention is also suitable to manufacturing multiple sections, for example, after forming the grooves 12 and 14 using wide rolls, the strip material is slit into a single tube width to manufacture a plurality of heat transfer tubes; in fact, such an arrangement would be more productive for producing the tubes according to the present embodiments.

Furthermore, the above mentioned tube 10 can be manufactured as well by using a metal tube. In this case, two types of plugs are drawn through the tube, the primary plug has the same protrusions 20 as the primary roll R1 shown in FIG. 5, and the secondary plug has the same protrusions 30 as the secondary roll R2 shown in FIG. 6.

Figure 8:
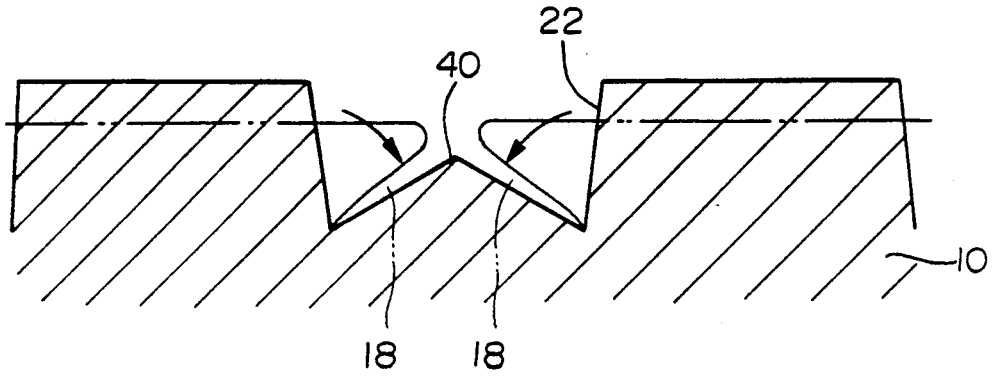
FIGS. 8 and 9 are enlarged cross sectional drawings to show methods for forming the narrow grooves of other embodiments of the present invention.
Figure 9:
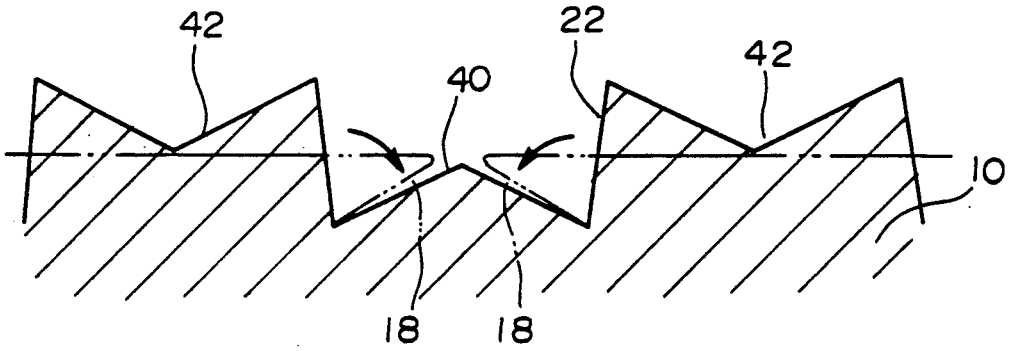

FIGS. 8 and 9 show the primary roll-forming processes of another embodiments of the present invention. In the embodiment of FIG. 8, the primary grooves 22 formed by the primary roll or plug has W-shape cross sections, the center portion 40 of the bottom face of each primary grooves 22 project triangularly. In this case, since the side faces of the primary grooves 22 are easily inclined closely toward the bottom face thereof by means of the secondary roll or plug, therefore, it is easy to form sharp cuts 18.

In the embodiment of FIG. 9, further, shallow grooves 42 having a V-shape are formed between the primary grooves 22 by the primary roll or plug. Therefore, it becomes easier to incline the side faces of the primary grooves 22 and to form sharp cuts 18.

Figure 10:
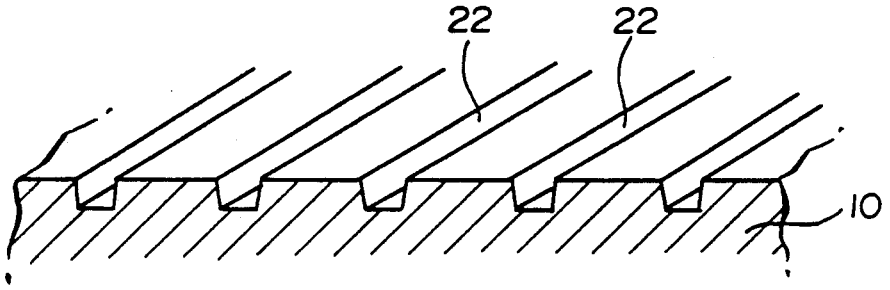
FIGS. 10–12 are cross sectional views to show other embodiment of methods for manufacturing heat transfer tubes.
Figure 11:
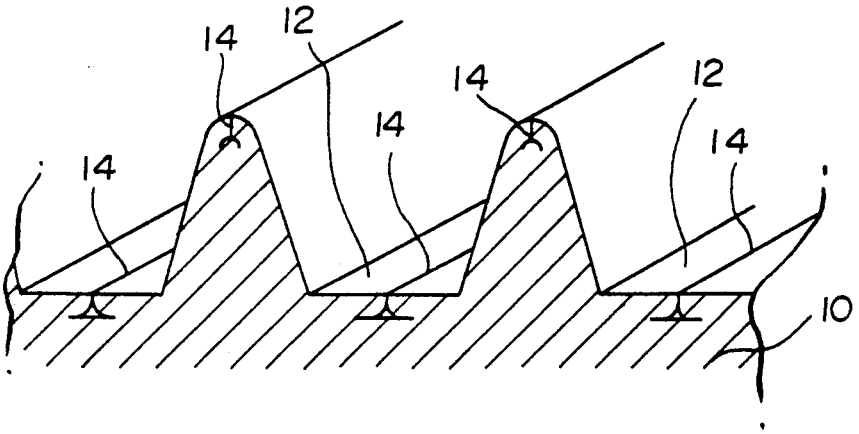
Figure 12:
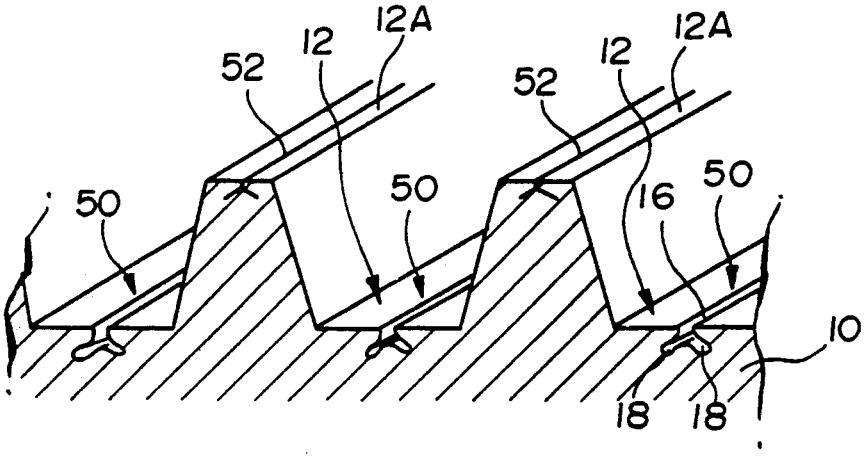

FIGS. 10–12 show the other embodiment of the method of the present invention. In this method, the primary grooves 22 are formed on the strip or the inside surface of the tube as well as the above mentioned embodiments. However, the main grooves 12 are formed parallel to the primary grooves by the secondary roll or plug as shown in FIG. 11, thereby a part of narrow grooves 14 are located inside the main grooves 12. The narrow grooves 14 can be closed completely at this stage, because the narrow grooves 14 will be open at following stage.

Next, the strip having grooves 12 and 14 is formed into a tube, and a enlarging plug having smooth periphery surface is inserted and drawn through the tube. By this process, the heads of the protruding portions 12A between main grooves 12 are flattened, and only the narrow grooves 14 inside the main grooves 12 are widened to form new narrow grooves 50 according to enlargement of the diameter of the tube 10 as shown in FIG. 12. In contrast, the narrow grooves 14, locating outside of the main grooves 12, are closed to form closed grooves 52.

In accordance with this embodiment, the widths of opening 16 of the narrow grooves 50 are determined by the enlarging ratio of the tube by the final drawing. Therefore, it is easy to control the width of opening 16 of the narrow grooves 50 exactly.

Furthermore, in the heat transfer tube manufactured by this method, since the narrow grooves 50 are parallel formed inside the main grooves 12, the capillary action of the main grooves 12 is accelerated. Therefore, the heat medium liquid can flow rapidly along the main grooves 12, it is possible to improve the transportation efficiency of heat medium.

If it is necessary to attach cooling fins to the outer periphery of the tube 10, this can be accomplished by press fitting the tubes through the holes in the fins by expanding the diameter of the tubes by means of the plug at the same time, with the above mentioned drawing process.

In the above case, the expanding ratio should be held to within 10% of the outer diameter of the tube, but more preferably to less than 7%. When the expanding ratio becomes greater than 10%, the increased compression of the inner surfaces results in a danger of a loss of beneficial effects produced by the narrow grooves 50 as a result of the wide opening of the narrow grooves 50 caused by the plug expansion operation.

Also, it is possible to utilize the tube expanding operation to improve the performance of the tube having crossed grooves as well, by suitably adjusting the operational parameters.

Figure 13:
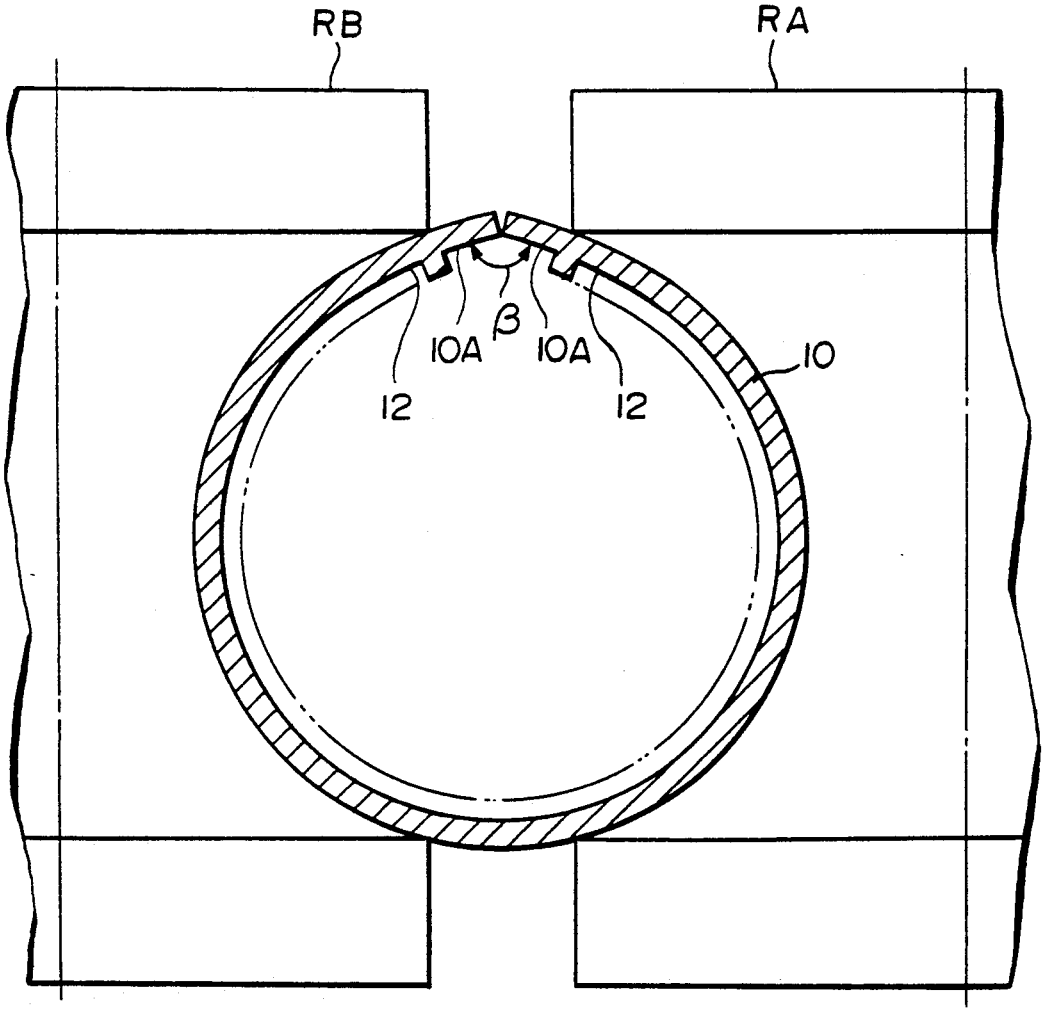
FIG. 13 is a cross sectional drawing to show roll-forming process of the heat transfer tube.
Figure 14:
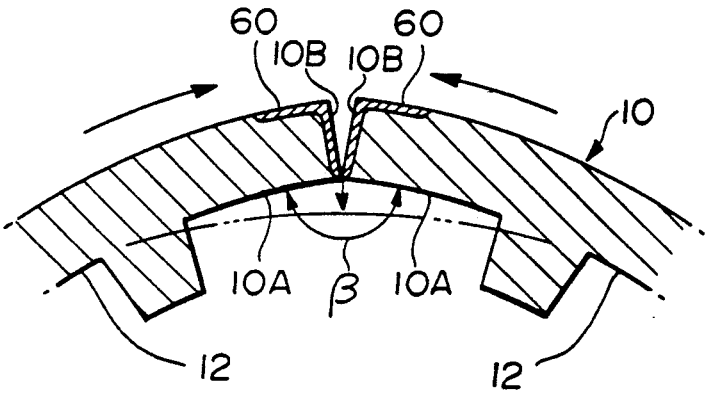
FIGS. 14 and 15 are enlarged cross sectional drawings to show welding process of the tube.
Figure 15:
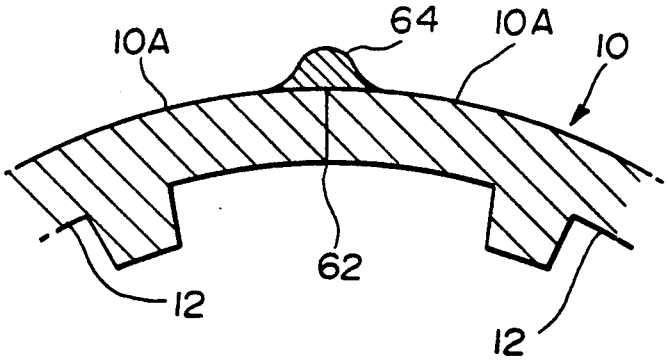

FIGS. 13–21 relate to improvements of the seam welding process of the present invention. In the embodiment of FIG. 13, the shaping rolls RA and RB are settled so that the side edges 10A and 10B of the metal strip 10 are butted each other at a angle B. This butting angle is generally 180°. However, in this embodiment, the angle B is preferably set in the range of 150°–170°. By means of setting the angle B in this range, at the time of seam welding, the melt 60 flows from inside toward outside of the tube as shown in FIGS. 14 and 15. Therefore, the protrusion 64 is formed only on the outer surface of the tube 10, it is possible to prevent such protrusion from being formed on the inner surface of the tube 10. If such protrusion 64 is formed on the inner surface of the tube, the protrusion comes off and sticks again to the inner surface of the tube when a plug is inserted in the tube. Such attachments cause the risk of a clogged up pump system, for example.

Figure 16:
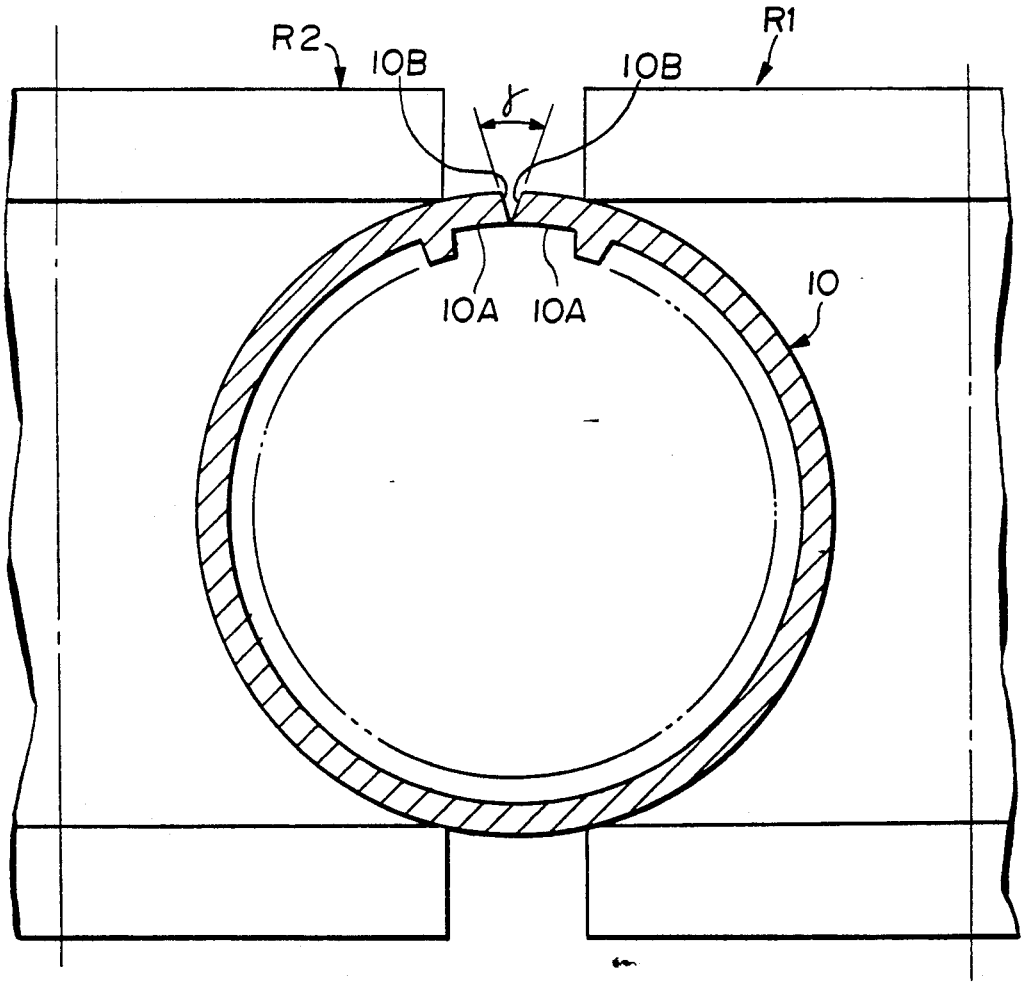
FIG. 16 is a cross sectional drawing to show a roll-forming process of the tube of the other embodiment.

In the embodiment of FIG. 16, the shaping rolls R1 and R2 are the usual ones. Instead of that, the end faces 10B of the side edges 10A are formed inclined beforehand, and the angle $\gamma$ is preferably set in the range of 5°–30°. This embodiment can offer the same effect as the embodiment of FIG. 13.

Figure 17:
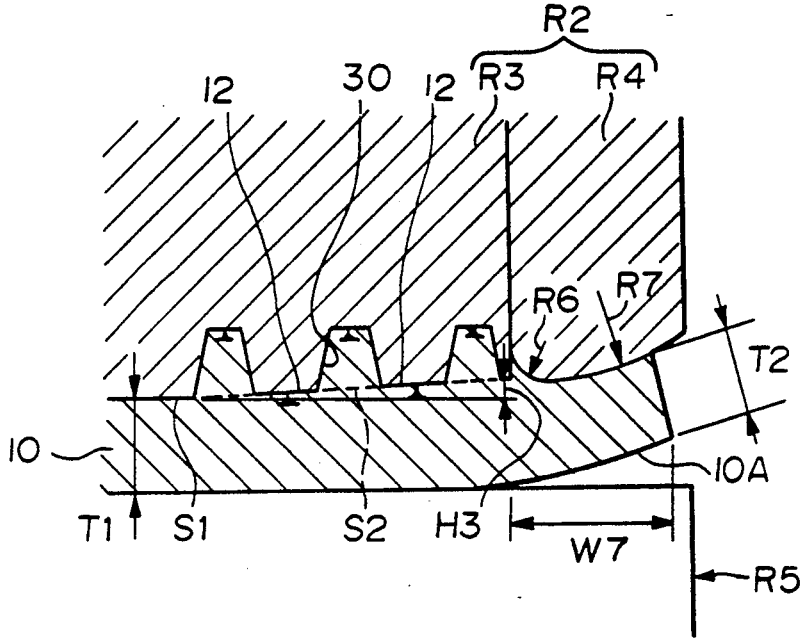
FIGS. 17 and 18 are cross sectional drawings to show roll-forming processes of the main grooves of the other embodiments.
Figure 18:
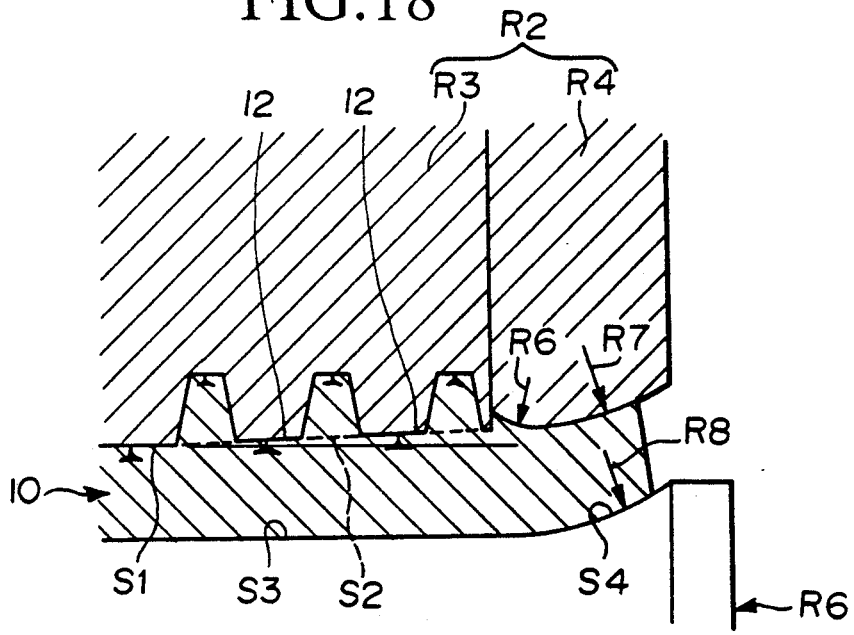

FIGS. 17 shows a roll-forming process of the main grooves 12 in other embodiment of the manufacturing method of the heat transfer tube, the strip 10 is rolled by the grooved roll R2 and smooth roll R5. The first characteristic of this embodiment exists where both side ends of the strip 10 are formed thicker than the other portion of the strip 10. And the second characteristic is that the side edges 10A of the strip 10 are formed round. By means of these two features, it is possible to prevent the welded portion of the heat transfer tube from denting when the tube is seam welded.

As shown in FIG. 17, the grooved roll R2 consists of a main roll R3 and a pair of side rolls R4 fixed to both ends of the main roll R3. The main roll R3 has a pair of taper portions S2 at both ends of the roll R3, whose diameters become smaller toward the ends of the roll R3. The radial reduction H3 of each taper portions S2 is preferably in the range of 0.2–0.7% of the diameter of the heat transfer tube to be manufactured. Also the width of each taper portion S2 is in the range of 5–15% of the width of the strip 10.

Each side roll R4 has a circumferential surface of a round cross section. The curvature R6 and R7 are preferably in the range of 2–8% and 40–80% of the diameter of the tube to be manufactured respectively. The width of the portion to be rolled by the side roll R4 is preferably in the range of 3–12% of the diameter of the tube. Although the roll R5 has simple cylindrical shape, the both edges 10A of the strip 10 warp and stick to the side rolls R4 when the strip 10 is rolled by the rolls R2 and R5, and the edges 10A will be formed into curved bands by the side rolls R4. It is because that elongation percentage of the grooved surface of the strip 10 is smaller than that of the smooth surface thereof.

Figure 19:
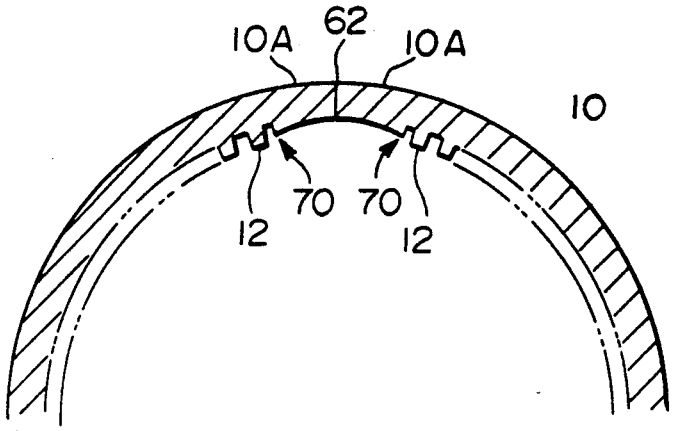
FIGS. 19–21 are cross sectional drawings to explain a effect of the embodiment of FIGS. 17 and 18.

In accordance with this embodiment, since the main roll R3 has taper portions S2 at the both ends thereof, it is possible to prevent reduction of thickness at portions 70 between each end 10A and grooved area of the tube as shown FIG. 19. In contrast, if the main roll R3 has a uniform diameter, the portions 70 of the strip 10 will be rolled thinner than the other portion S1 of the strip, therefore, the portions 70 of the tube become weaker, and the risk arises that the portions 70 will be torn when high pressure is applied inside the tube. This is a characteristic problem in the manufacturing the inner grooved tubes.

Figure 20:
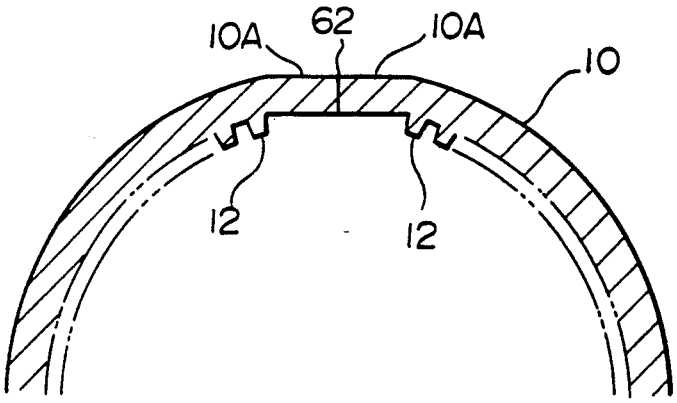
Figure 21:
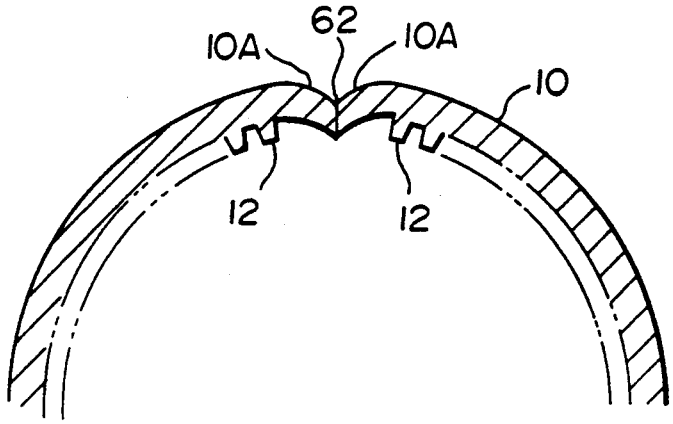

Furthermore, since the side rolls R4 have round cross sections, the both side edges 10A of the strip 10 will be formed into curved bands having a curvature corresponding to that of the outer surface of the tube to be manufactured, as shown in FIG. 19. Accordingly, when this strip is roll-formed into the tube, outer surfaces of the curved bands 10A agree with ideal outer surface of the tube 10, and it is possible to prevent the welded portion of the heat transfer tube from denting. In contrast, if both side ends 10A of the strip 10 is formed to be flat, a risk arises that the both side ends 10A are butted flat to each other as shown in FIG. 20 when the strip is formed to be the tube 10. In such a case, the side ends 10A are dented toward inside of the tube 10 as shown in FIG. 21, and a long dimple will be formed on the outer surface of the tube 10.

EXAMPLE

The heat transfer tubes of the present invention were manufactured and tested in comparison with the heat transfer tubes of prior art, simple grooved tube, and plain tube.

Sample 1

Using copper strip materials of 30 mm width by 0.5 mm thickness, experimental heat transfer tubes were produced by subjecting them to primary and secondary roll-forming and tube forming processes. The diameter of manufactured tube was 9.52 mm. The rolls used for grooving the strip have the same shapes as FIGS. 5 and 6, the angle between the longitudinal direction of the strip and each of the primary and secondary grooves formed by the rolls were 18° and 19° respectively. The sizes of the rolls were as follows:

The primary roll:
diameter=50 mm
H2=0.10 mm
W5=0.06 mm
W6=0.14 mm
draft=20%
The secondary roll:
diameter=50 mm
H1=0.30 mm
W1=0.24 mm
W2=0.27 mm
draft=25%

Next, A plug having a diameter of 9.00 mm and a smooth surface was drawn through the tube, and the heat transfer tube shown in FIG. 12 was produced. The sizes of the tube according to the references in FIG. 3 were follows:

The width W3 of the opening of the narrow grooves: 0.01 mm
The bottom width W4 of the narrow grooves: 0.04 mm
The depth D2 of the narrow grooves: 0.02 mm
The depth D1 of the main grooves: 0.30 mm
The angle between the main grooves and the narrow grooves: 1°

Sample 2

Using copper tube of 9.52 mm diameter and 0.30 mm thickness, experimental heat transfer tubes were produced by subjecting them to primary and secondary drawing. The plugs used for the drawing processes had the same shapes as FIGS. 5 and 6, the angle between the longitudinal direction of the tube and each of the primary and secondary grooves formed by the plugs were 18° and 342° respectively. The sizes of the plugs were as follows:

The primary plug:
H2=0.10 mm
W5=0.39 mm
W6=0.16 mm
The secondary plug:
H1=0.20 mm
W1=0.24 mm
W2=0.27 mm The sizes of the manufactured tube according to the references in FIG. 3 were as follows:

The width W3 of the opening of the narrow grooves: 0.02 mm
The bottom width W4 of the narrow grooves: 0.10 mm
The depth D2 of the narrow grooves: 0.02 mm
The depth D1 of the main grooves: 0.20 mm
The angle between the main grooves and the narrow grooves: 36°

Sample 3 (prior art)

Figure 33:
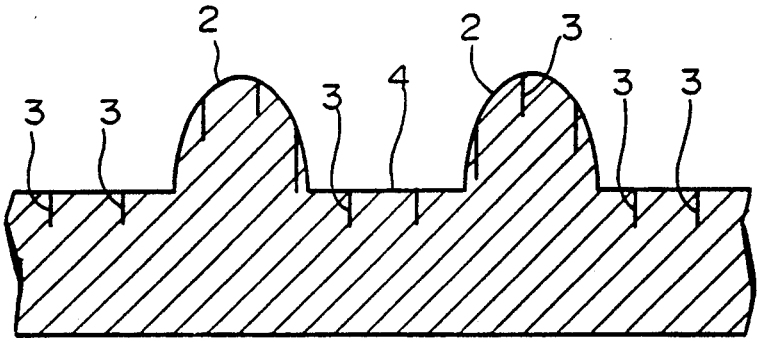
FIG.33 PRIOR ART
FIG. 33 is a cross sectional drawing of a heat transfer tube of the prior art.

Using same copper tubes as that of Sample 2, heat transfer tubes shown in FIG. 33 were produced by subjecting them to primary and secondary drawing. All sizes of primary plug were same as those of the Sample 2, only except the shape of protrusions formed on the periphery of the primary plug. The protrusions of this primary plug had V-shape cross sections instead of rectangular cross sections. The secondary plug used for this sample 3 was the same as Sample 2.

By means of the primary and secondary drawings, many main grooves and perpendicular cuts were formed on the inner surface of the tube. The depths of cuts were 0.05 mm, and the opening widths of the cuts were 0.01 mm.

Sample 4 (simple grooved tube)

Using same copper tube as Sample 2, the secondary plug used in Sample 2 were drawn through the tube in order to produce a simple grooved tube.

Sample 5 (plain tube)

The copper tube used in the Sample 2 was used as Sample 5 without grooving.

Experiment 1

Figure 22:
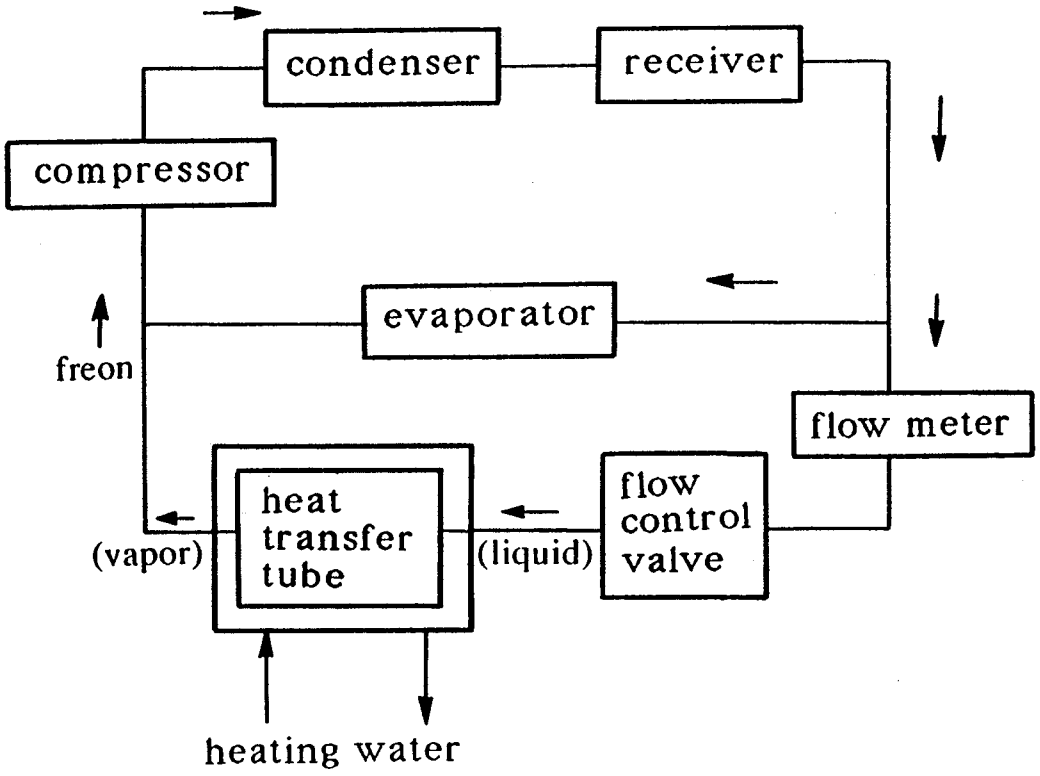
FIG. 22 is a block flow diagram to show a machine for evaporation performance test of the heat transfer tube.
Figure 23:
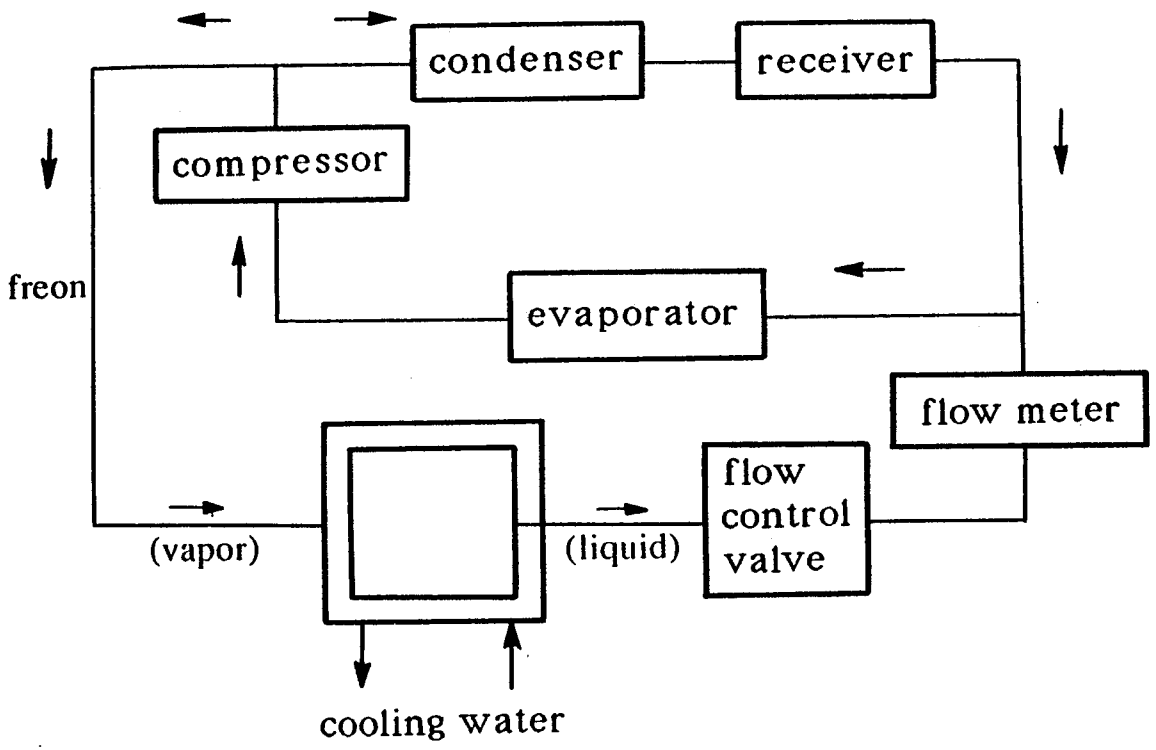
FIG. 23 is a block flow diagram to show a machine for condensation performance test of the heat transfer tube.

Tests for the evaporation and condensation performances were carried out on the heat transfer tubes of the Samples 1–5 respectively, as shown in FIGS. 22 and 23. The length of each transfer tube was 500 mm, freon was used as heat medium in both tests, and heat conductivities between the heat medium flowing inside the tube and water flowing outside of the tube were measured. Conditions of measurements are as follows:

Evaporation performance test:
flow rate of the heat medium: 30, 60, 90 kg/hour
pressure of the heat medium: 4 kg/cm$^2$
temperature of the heating water:
temperature of the heat medium liquid +3° C.
flow speed of the heating water: 1.5 m/sec.

Condensation performance test:
flow rate of the heat medium: 30, 60, 90 kg/hour
pressure of the heat medium: 17 kg/cm$^2$
temperature of the cooling water:
temperature of the heat medium vapor −5° C.
flow speed of the cooling water: 1.5 m/sec.

Figure 24:
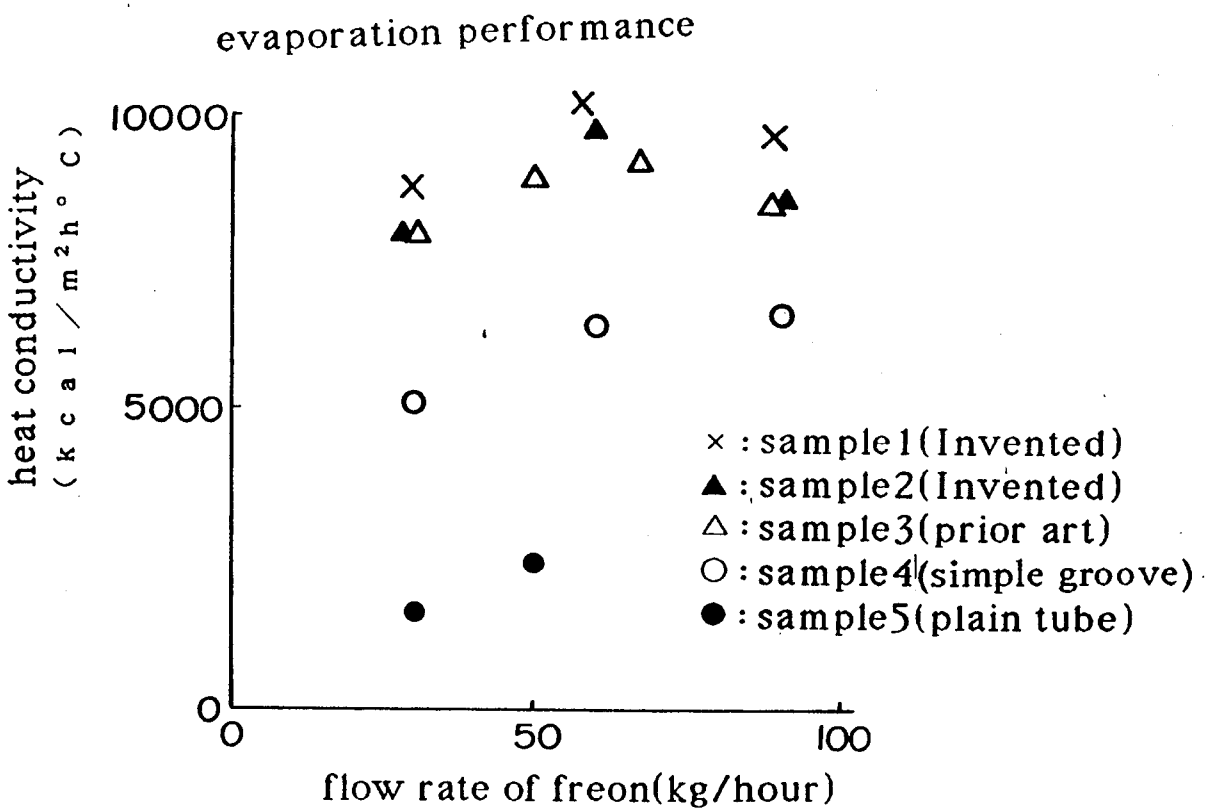
FIG. 24 is a graph to show the results of the evaporation performance tests.
Figure 25:
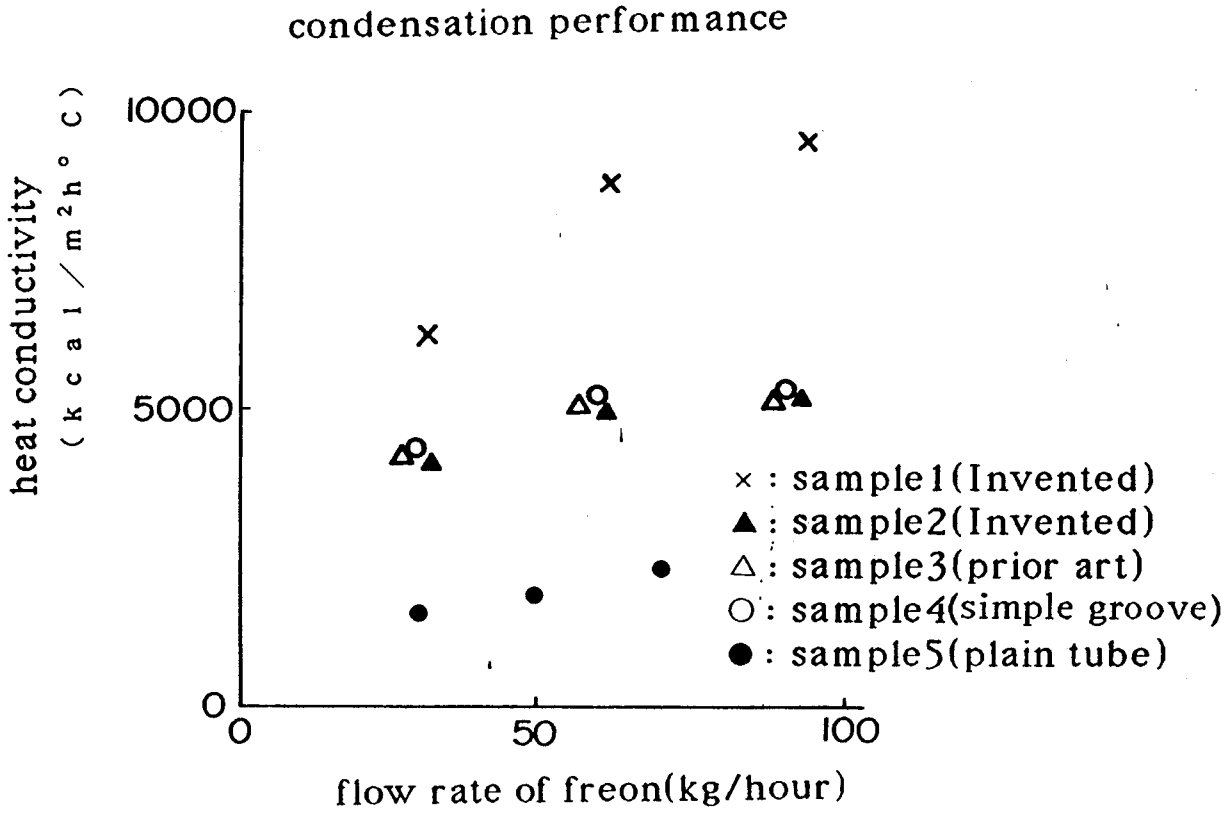
FIG. 25 is a graph to show the results of the condensation performance tests.

FIGS. 24 and 25 are the graphs showing the results of the tests. As shown in these figures, Sample 1 offered superior evaporation and condensation performances in comparison with Sample 2–5. Also, Sample 2 offered almost same evaporation and condensation performances as Sample 3.

Experiment 2

Figure 26:
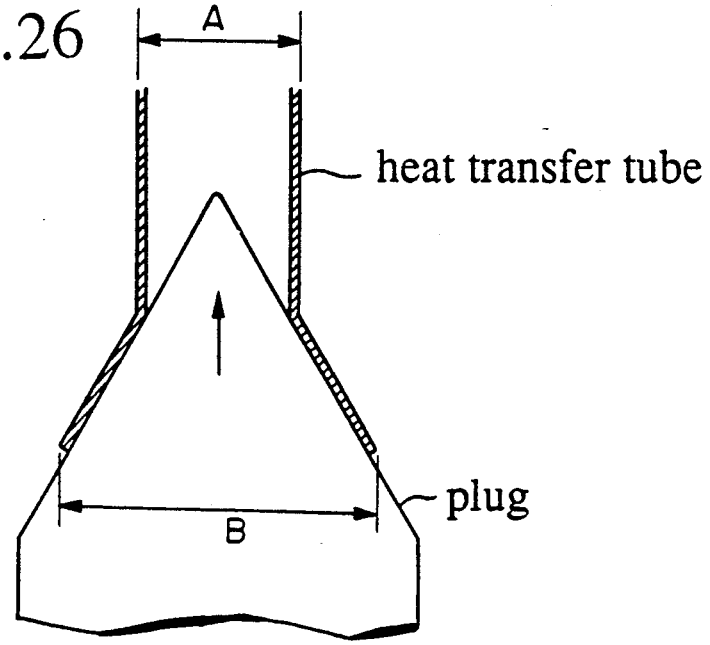
FIG. 26 is a cross sectional drawing to show an enlarging test of the heat transfer tube.

Strength against expansion of the Samples 1–3 were measured as shown in FIG. 26. A plug having a circular cone head was inserted in the end of each tube, and maximum diameter B where the tube began to crack was recorded. The angle of the head point of the plug waa 60°. Ratios of the maximum diameter B to the original diameter A of the samples 1–3 were as follows:

Sample 1: 1.52
Sample 2: 1.51
Sample 3: 1.39

A required standard specification of the ratio B/A is 1.40, therefore the Samples 1 and 2 are on the specification, however Sample 3 was off specification.

Figure 27:
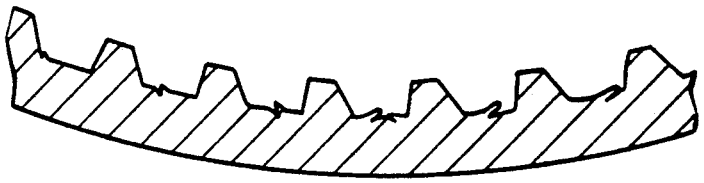
FIGS. 27–30 are cross sectional photographs of the samples enlarged by means of the plug insertion.
Figure 28:
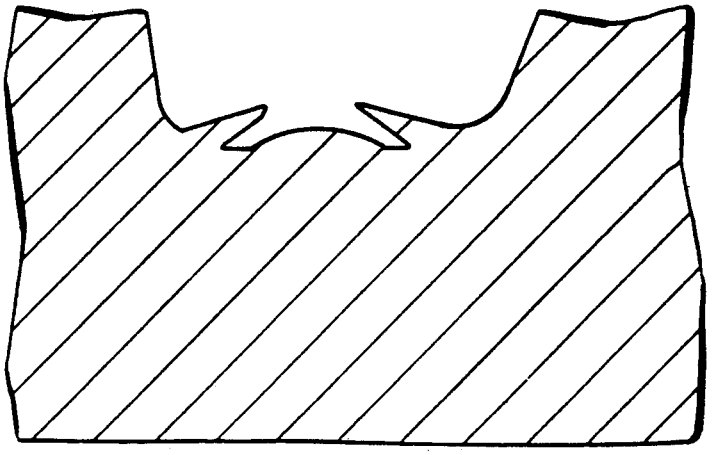
Figure 29:
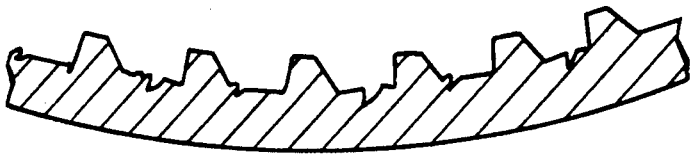
Figure 30:
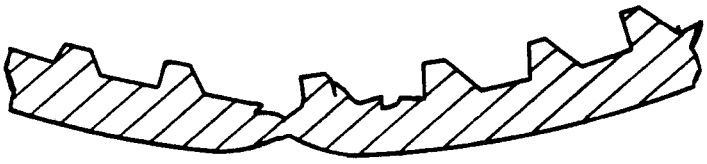

FIGS. 27 and 28 are cross sectional photographs of the enlarged end of Sample 2 when the ratio B/A was 1.40. Deformation of the grooves is not so conspicuous in this Sample 2. In contrast, FIGS. 29 and 30 show the enlarged end of Sample 3 when the ratio B/A was same 1.40. As shown in these figures, the cuts formed on the inner surface caused cracks toward the outer surface of the tube.

Figure 31:
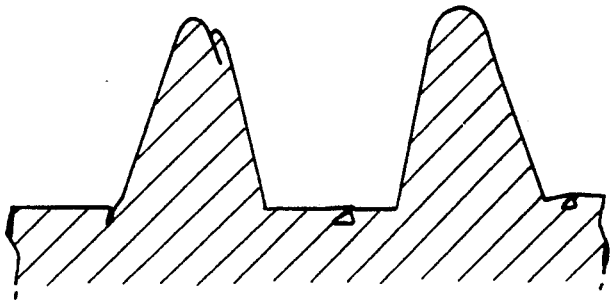
FIGS. 31 and 32 are cross sectional photographs of the sample of other embodiment.
Figure 32:
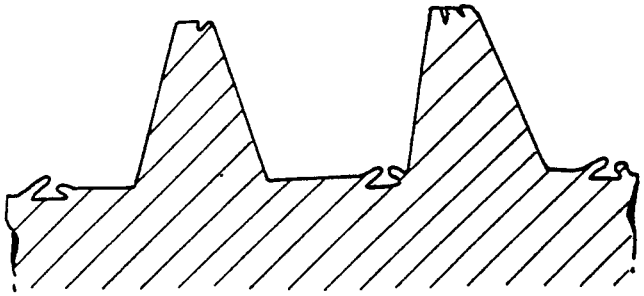

Furthermore, FIG. 31 shows a cross sectional photograph of the tube of Sample 1 before the drawing process, FIG. 32 shows same tube after the drawing process. The narrow grooves were opened by the drawing process.

What is claimed is:

1. A heat transfer tube having an inner surface in which are formed:

(a) a plurality of main grooves, having a rectangular shaped cross section and parallel to one another, extending at an angle to a longitudinal direction of the heat transfer tube, (b) a plurality of narrow grooves, being parallel to one another, extending at an angle to the longitudinal direction of the heat transfer tube, each of the narrow grooves having a bottom face and a pair of side faces, the side faces being inclined closely toward the bottom face, thereby each of the side faces and the bottom face forming a sharp cut respectively, wherein an angle between the inner surface of the heat transfer tube and a depth direction of each of the cuts is less than 20°.

2. A heat transfer tube according to claim 1, wherein the narrow grooves intersect the main grooves.

3. A heat transfer tube according to claim 1, wherein the narrow grooves are formed inside the main grooves parallelly therewith.

4. A heat transfer tube according to claim 1, wherein at least deep part of each of the cuts is closed.

5. A heat transfer tube according to claim 1, wherein the bottom faces of the narrow grooves are located at a depth of 0.01–0.05 mm from the inner surface of the heat transfer tube.

6. A heat transfer tube according to claim 1, wherein the width of the bottom face of each narrow groove are in the range of 0.03–0.10 mm.

7. A heat transfer tube according to claim 1, wherein widths of openings of the narrow grooves are in the range of 2–10% of widths of the bottom faces of the narrow grooves.

8. A heat transfer tube according to claim 1, wherein depths of the main grooves are in the range of 0.15–0.35 mm, widths of the main grooves are in the range of 0.15–0.30 mm and intervals between main grooves are in the range of 0.15–0.30 mm.

9. A heat transfer tube according to claim 1, wherein the heat transfer tube is made of a material selected from the group consisting of copper, copper alloys, aluminum and aluminum alloys.

10. A heat transfer tube according to claim 1, wherein a welding seam is formed on the inner surface of the heat transfer in the longitudinal direction of the heat transfer tube, and the main grooves and the narrow grooves are divided by the welding seam.

11. A heat transfer tube according to claim 1, wherein the angle between the main grooves and the longitudinal direction of the heat transfer tube is less than 30°.

* * * * *